United States Patent [19]

Hasebe et al.

[11] 4,042,090

[45] Aug. 16, 1977

[54] KEY TOP

[75] Inventors: Sadao Hasebe, Tokyo; Hiromitsu Ono, Ichikawa; Minoru Murata, Yokohama; Yuji Harada, Tokyo, all of Japan

[73] Assignees: Canon Kabushiki Kaisha; K.K. Chiyoda Gurabiya Insatsusha, both of Tokyo, Japan

[21] Appl. No.: 506,871

[22] Filed: Sept. 17, 1974

[30] Foreign Application Priority Data

Sept. 20, 1973 Japan ..... 48-106275

[51] Int. Cl.[2] ..... B41J 5/12

[52] U.S. Cl. ..... 197/102; 178/110

[58] Field of Search ..... 178/101, 110; 197/102–104; 200/333, 340

[56] References Cited

U.S. PATENT DOCUMENTS

| | | | |
|---|---|---|---|
| 1,415,029 | 5/1922 | Hayes | 197/102 |
| 2,188,385 | 1/1940 | Brown | 197/102 |
| 2,211,969 | 8/1940 | Dowd | 197/102 |
| 2,615,549 | 10/1952 | Marlow | 197/102 |
| 2,714,949 | 8/1955 | Morin | 197/102 |
| 2,892,529 | 6/1959 | Heinze et al. | 197/102 |
| 2,947,404 | 8/1960 | Siebels et al. | 197/102 |
| 2,970,970 | 2/1961 | Prichard | 197/102 X |
| 3,648,394 | 3/1972 | Hepner | 197/102 X |
| 3,848,723 | 11/1974 | Hogue | 197/102 |
| 3,871,506 | 3/1975 | von Luders | 197/102 X |

*Primary Examiner*—Edgar S. Burr
*Assistant Examiner*—Paul T. Sewell
*Attorney, Agent, or Firm*—Fitzpatrick, Cella, Harper & Scinto

[57] ABSTRACT

A key top comprises a key top base comprising a side portion and a top portion having a specified color, a colored portion provided at a part of the top portion and having a color different from the specified color of the top portion, and, a protective layer composed of a transparent material having an abrasion resistance and covering at least the colored portion.

1 Claim, 12 Drawing Figures

KEY TOP

BACKGROUND OF THE INVENTION

1. Field of the Invention

This invention relates to a key top, and more particularly, to a key top having a sign on the top portion.

2. Description of the Prior Art

At the top portion of a key top of electronic desk top calculators and typewriters there is usually provided a sign including letters or numerals which designates a type of signal input by driving the key or a type of mechanism for driving. The portion of the key top having the sign is pushed with a finger or the like so that the sign on a key top needs to be durable and of abrasion resistance. In order to satisfy such conditions there are widely used two-color shaped key tops produced by two-color shaping.

The two-color shaped key top is produced by shaping the outside of a key top and pouring a resin in a first mold capable of providing a vacant part in the key top where a sign is to be formed (first step) and fitting the key top thus obtained in a second mold and pouring another resin having a color different from that of the above mentioned resin to fill the vacant part with the other resin (second step).

The sign at the top portion of the key top thus produced is very strong and has an abrasion resistance corresponding to the resin forming the sign.

As mentioned above, the key top having a sign formed by a two-color shaping process is excellent because it has various characteristics necessary for a key top. However, when only a small amount of key tops are produced by one mold corresponding to each sign, the unit cost of the key top is very high. In addition, the sign is formed as a vacant part in the first step so that it is difficult to manufacture a mold for a complicated sign such as chinese characters and the like.

SUMMARY OF THE INVENTION

According to the present invention there is provided a key top which comprises a key top base comprising a side portion and a top portion having a specified color, a colored portion provided at a part of the top portion and of a color different from the specified color of the top portion, and a protective layer composed of a transparent material having an abrasion resistance and covering at least the colored portion.

An object of the present invention is to provide a key top suitable for small quantity production.

Another object of the present invention is to provide a key top adapted to have a complicated sign on the top portion capable of being easily formed.

A further object of the present invention is to provide a key top having a durable sign on the top portion.

Still another object of the present invention is to provide a key top which can be easily manufactured.

DESCRIPTION OF THE PREFERRED EMBODIMENTS

Figure 1A:
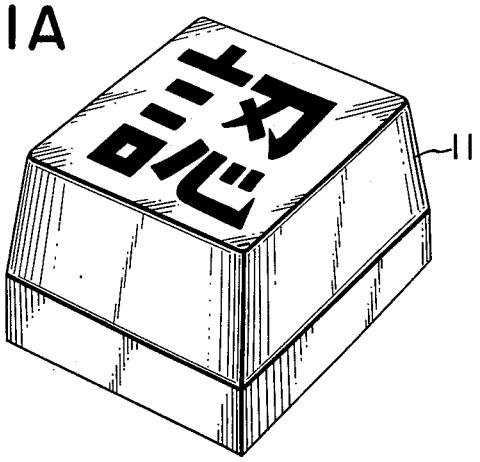
FIG. 1A is a perspective view of a key top according to the present invention.

FIG. 1A shows a perspective view of a key top according to the present invention on which there is a complicated sign, i.e. a chinese character, "nin".

Figure 1B:
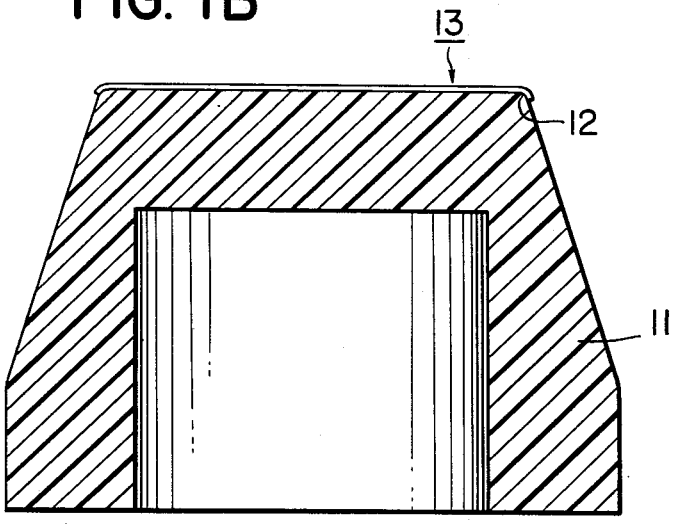
FIG. 1B is a cross sectional view of the key top of FIG. 1A.

As is clear from FIG. 1B, the key top of FIG. 1A is formed by providing a fixed portion 13 on the top portion 12 of a key top base 11.

Figure 1C:
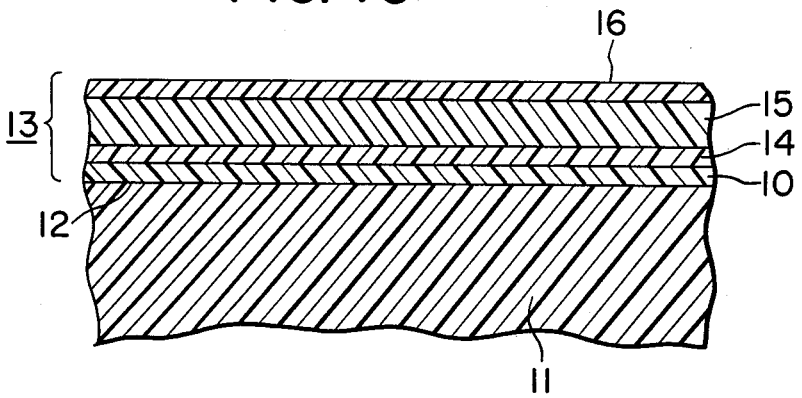
FIG. 1C is an enlarged upper portion of the key top of FIG. 1B.

Referring to FIG. 1C, there is provided an adhesion layer 10 on the top portion 12 of a key top base 11. Adhesion layer 10 serves to adhere a colored portion 14 and a protective layer 15 to the top portion 12 of a key top base 11. Though FIG. 1C shows a colored portion 14 present over the entire area, a colored portion 14 is present in a form of a sign and therefore there may be a part where the protective layer 15 directly contacts adhesion layer 10.

On the protective layer 15 is provided a peeling layer 16 composed of a transparent material. These layers and portions are tightly fixed to each other and to the top portion 12 of a key top base 11.

The peeling layer 16 is formed as a result of producing the fixed portion on the key top base by a transferring method (infra.). If the material of a protective layer 15 is selected appropriately, the protective layer 15 can also behave as a peeling layer. Further, if the material of a colored portion 14 and a protective layer 15 are selected appropriately, an adhesion layer 10 may be omitted.

In short, the essential feature of the present invention is that a colored portion in a sign form is provided on the top of a key top base and at least the colored portion is covered with a protective layer composed of a transparent material having an abrasion resistance.

Each layer of a fixed portion 12 on the top portion 13 of a key top base 11 may be composed of thermosetting resins such as melamine resins, urea resins, alkyd resins, vinyl resins, urethane resins and derivatives thereof, natural resins such as rubber, tar, acaroid resin, guaiacum resin and the like, thermoplastic resins such as nylon series resins, rubber series resins, vinyl series resins, acryl series resins, styrene series resins, and cellulose resins. If necessary, the peeling layer may contain an agent facilitating peeling such as silicone, wax and the like so as to impart a good peeling property serving for easy peeling from a printing base.

Hereinafter, parts are by weight unless otherwise specified.

An example of a formula for producing the peeling layer is as shown below and the layer may be produced in the thickness of about 8 microns.

| | |
|---|---|
| Polyvinyl chloride | 25 parts |
| synthetic rubber | 5 parts |
| Silicone | 0.5 parts |
| A mixture of toluene and methyl ethyl keton (MEK) | 79.5 parts |

A protective layer 15 serves to protect the colored portion and reinforce the peeling layer and thereby prevent falling of the colored portion and improve the abrasion resistance. These effects can be further increased by using a thermoplastic resin or thermosetting resin of high hardness and forming a thick layer.

Examples of formula for producing a protective layer are thermoplastic and thermosetting mixtures as shown below and the layer may be formed in the thickness of about 20 microns.

| | |
|---|---|
| Thermoplastic mixture: | |
| Polyvinyl chloride | 10 parts |
| Nitrocellulose | 20 parts |
| A mixture of toluene, MEK and ethyl acetate | 70 parts |
| Thermosetting mixture: | |
| Amino alkyd resin | 24 parts |
| Para-toluene sulfonic acid | 5 parts |
| A mixture of toluene, ethyl acetate and MEK | 71 parts |

As a material composing a colored portion 14, there may be used an ink for photogravure, silk and offset printing and it may be of a solvent drying type a baking type or a hot melt type. When an ink of a hot melt type is used, it can also work as an adhesion layer. An example of formula for producing a colored portion is as shown below.

| | |
|---|---|
| A mixture of polyvinyl chloride and poly methyl methacrylate | 20 parts |
| Colorant (pigment) | 10 parts |
| A mixture of toluene and MEK | 70 parts |

With respect to an adhesion layer 10, it is important to select a material capable of matching with the material of the key top base. When the key top base is composed of an ABS resin or polystyrene, the following formula may be used.

| | |
|---|---|
| Styrene resin | 25 parts |
| Synthetic rubber | 5 parts |
| A mixture of toluene and MEK | 70 parts |

When the key top base is composed of acrylic resin or vinyl chloride resin, there may be used vinyl chloride resin or acrylic resin for an adhesion layer composition. When the key top base is composed of acetyl cellulose, there may be used an acetyl cellulose resin for an adhesion layer composition. When the key top base is composed of nylon resin, there may be used a polyamide resin for an adhesion layer composition. When the key top base is composed of a thermosetting resin such as melamine resin, polyester resin, urea resin, phenolic resin, amino alkyd resin and the like, or a metal, there may be used a hot melt type or thermosetting adhesive. In this case, there may be polyurethane, synthetic resin, modified synthetic resin, modified epoxy resin, phenolic resin and a mixing type adhesive as the adhesion layer.

For example, when the key top base is composed of a metal, melamine resin, or bakelite, there may be employed the following mixture.

| | |
|---|---|
| Neoprene AC | 18 parts |
| Zinc oxide | 1 parts |
| Manganese oxide | 1 parts |
| Antioxidant | 0.5 parts |
| Phenol | 8 parts |
| Toluene | 71.5 parts |

Figure 2A:
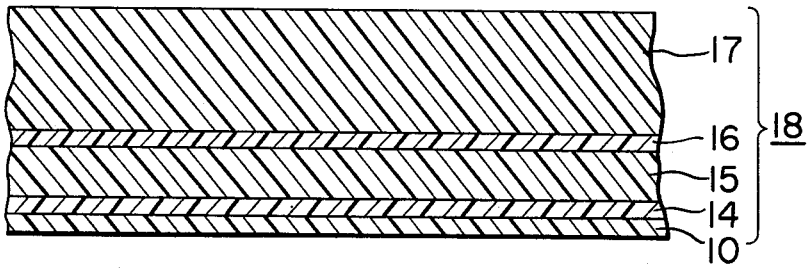
FIG. 2A is a cross sectional view of a transferring sheet.

Referring to FIG. 2A, a transferring sheet 18 is composed of a printing base, 17 and a layer to be transferred to the key top consisting of a peeling layer 16, a protective layer 15, a colored portion 14 and an adhesion layer 10. Printing base 17 may be composed of plastic film, paper, parchment paper, cellophane, parting paper or combination thereof. In such transferring sheet, a surface in contact with the peeling layer may be smooth or rough or composed of a material capable of deforming by heat so as to obtain a lustered or lusterless surface of the fixed portion 13 when transferred to the key top.

Figure 2B:
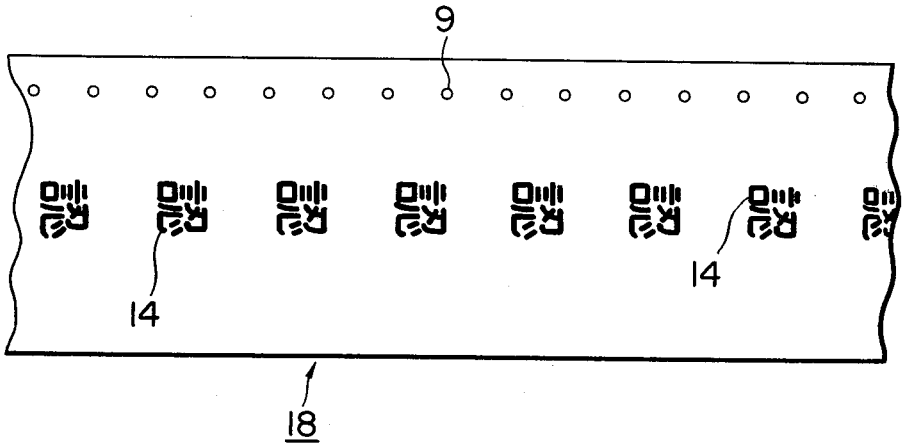
FIG. 2B is a plane view of the transferring sheet.

Referring to FIG. 2B, the transferring sheet 18 is in form of a tape and has colored portions 14 in a form of sign (chinese character, "nin") placed at regular intervals and punched holes 9 on one side of the tape at regular intervals.

Figure 3A:
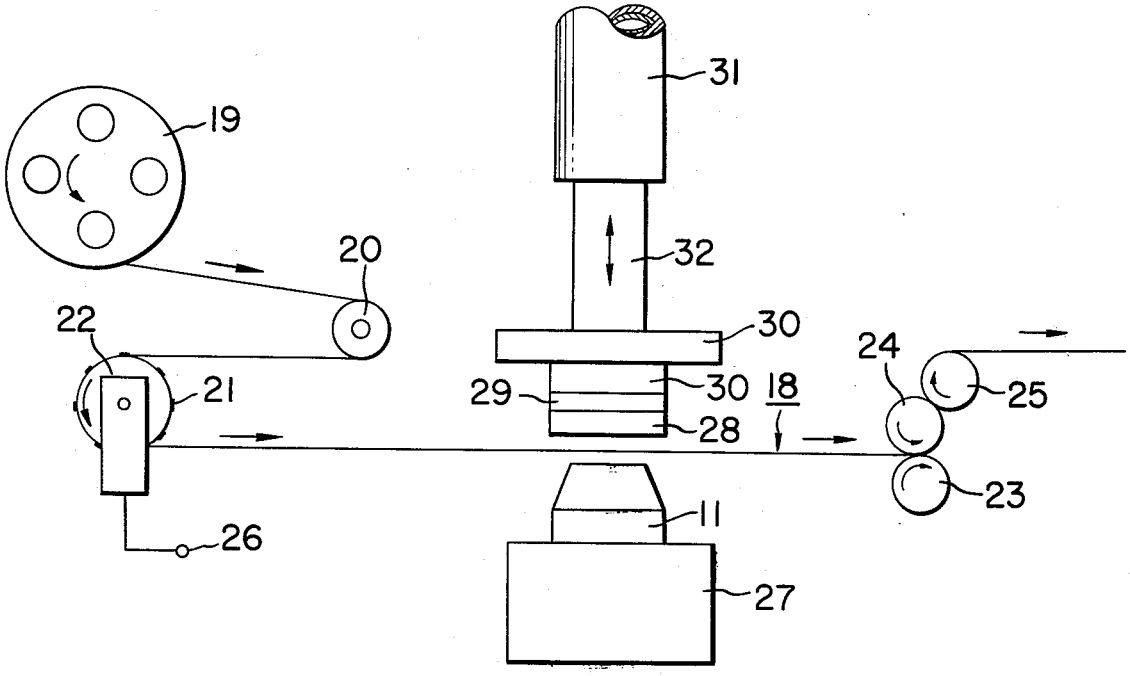
FIG. 3A schematically shows a transferring apparatus.

Referring to FIG. 3A, there is illustrated a transferring apparatus for transferring colored portions to key tops by using a transferring sheet. The transferring sheet is wound on a rotatable reel 19. Transferring sheet 18 from reel 19 is fed to rolls 23, 24 and 25 by way of a rotatable roll 20 and a wheel 22 having pawls 21 engaging punched holes 9.

Wheel 22 rotates by a certain angle when an electric signal is applied from terminal 26, and rolls 23, 24 and 25, always rotate. Therefore, when wheel 22 is stopped, transferring sheet 18 is pulled by rolls 23, 24 and 25 and streched and slipped on the rolls. When an electric signal is applied to terminal 26, transferring sheet 18 moves in the direction of arrow by a certain distance.

In the path of the transferring sheet there are provided a key top 11 on a fixed table 27 the top portion of the key top facing a side of the transferring sheet opposite to a printing base layer, and a heating apparatus consisting of silicon rubber 28, aluminum plate 29, and heating member 30 fixed to a piston 32 fitted to a cylinder 31 and facing the printing base side of the transferring sheet. Consequently, for the purpose of transferring and fixing each layer and colored portion of the transferring sheet to key top 11, piston 32 descends and the silicon rubber 28 heated to 150°–250° C presses the transferring sheet to a key top 11 at a pressure of 3–13Kg/cm$^2$. as shown in FIG. 3B.

Figure 3B:
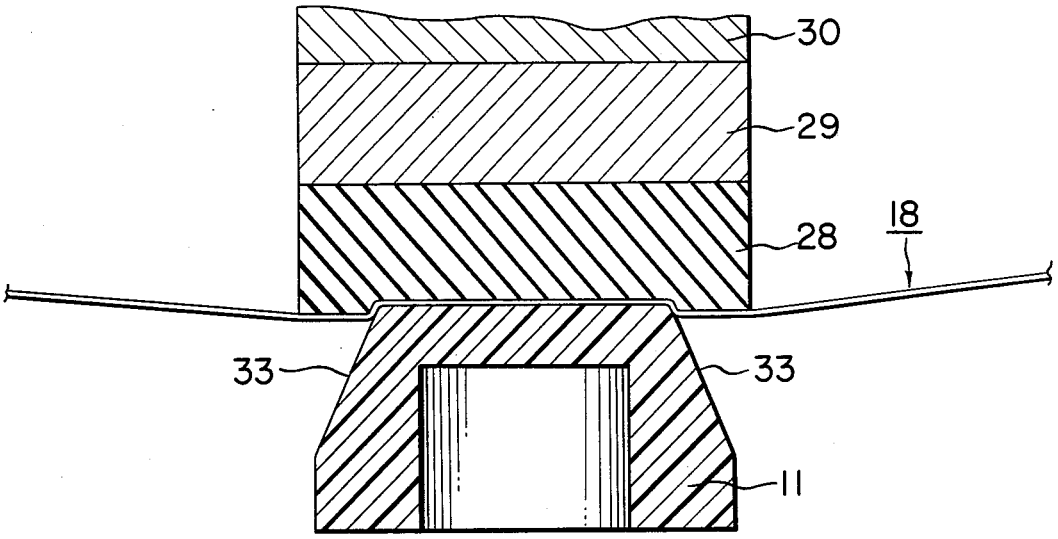
FIG. 3B is a cross sectional view of a part of the transferring apparatus.
Figure 3C:
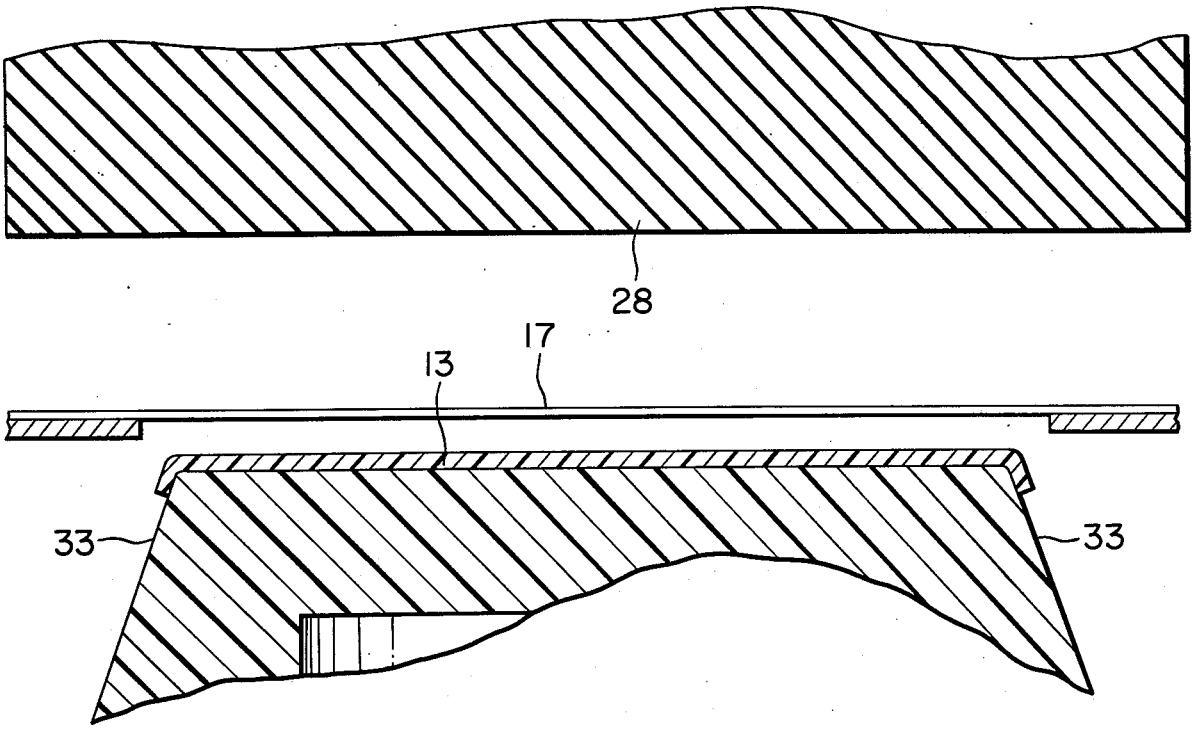
FIG. 3C is a cross sectional view of a part of the transferring apparatus showing a state where the transferring has been effected.

After pressing in this way for a certain period of time, piston 32 is pulled upwards and thereby a peeling layer of the transferring sheet corresponding to the portion pressed onto the key top is peeled off from the transferring base and fixed to the top of the key top as illustrated in FIG. 3C.

As shown in FIG. 3B, elastic silicone rubber 28 presses transferring sheet 18 to key top 11 and thereby transferring sheet 18 is pressed to the upper portion of the side portion 33 as well as the top portion of key top 11. Thus layer 13 is transferred up to the upper portion of the side portion 33 as shown in FIG. 3C. This extension of the transferred layer 13 up to the upper portion of the side portion 33 of the key top serves to prevent the transferred layer from being peeled off when a finger touches the end portion of the transferred layer 13 and therefore, the fixed portion can be tightly fixed to the key top.

After finishing the transferring for one key top, another key top is mounted on a support and a signal is applied to terminal 26 to rotate the wheel by a certain definite angle and to move the transferring sheet up to a portion where another sign corresponds to said another key top and then the above mentioned procedure is repeated to carry out the next transferring. Thus, many key tops having a sign can be obtained.

When a different sign is desired, for example, the transferring sheet having one kind of sign is removed from the reel and another transferring sheet having a sign different from the previous on is placed on the reel and the same procedure as above is repeated, or it is another idea to use a transferring sheet having many kinds of signs thereon.

In the above embodiments there are shown various methods where the transferring is effected only one by one, but it should be noted that a plurality of signs may be simultaneously transferred to a plurality of key tops.

Figure 4A:
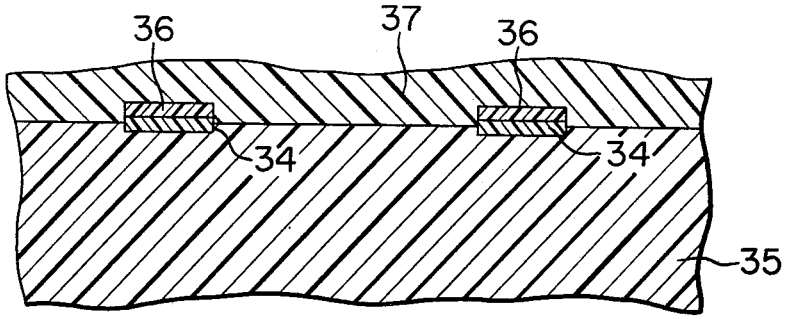
FIG. 4A is an enlarged cross sectional view of a key top of an embodiment of the present invention.

FIG. 4A shows a further embodiment of the present invention in which a colored portion 34 is directly provided on the top portion of a key top 35 and a peeling layer 36 and a protective layer 37 overlie colored portion 34. An example of materials of the colored portion and the layer is shown below. The key top may be a synthetic resin such as nylon.

Peeling layer 36 may be formed by using the formula:

| | |
|---|---|
| Polyvinyl chloride | 18 parts |
| Cellulose resin | 7 parts |
| Armoslip CP (supplied by Lion Armour Co. Ltd.) | 1 part |
| Synthetic rubber | 4 parts |
| A mixture of toluene, methyl ethyl ketone and ethyl acetate | 70 parts. |

Colored portion 34 may be formed by using the following formula:

| | |
|---|---|
| Polyamide resin | 25 parts |
| Toluene and isopropyl alcohol | 60 parts |
| pigment | 15 parts. |

Protective layer 37 may be formed by employing the following formula

| | |
|---|---|
| Polyol | 23 parts |
| Isocyanate | 8 parts |
| A mixture of methyl isobutyl ketone, toluene and ethyl acetate | 69 parts. |

Figure 4B:
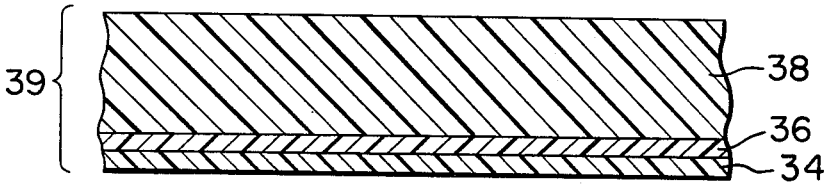
FIG. 4B is an enlarged cross sectional view of a transferring sheet.

The key top as shown in FIG. 4A may be produced by a stamping method. A stamping sheet 39 composed of a printing base 38, a peeling layer 36, and a colored layer 34 which is not in a form of a sign, but is uniformly formed on the peeling layer 36, as shown in FIG. 4B. The stamping sheet 39 is wound on reel 19 (in FIG. 3A) and fed to reels 22, 23, 24 and 25. In the stamping method, a printing type metal plate having a sign is employed in place of silicone rubber 28 in FIG. 3A. When the printing type metal plate presses the stamping sheet to a key top, colored layer 34 and peeling layer 36 corresponding to the printing type portion are transferrdd to the top portion of the key top. In such a stamping method, only as part of top portion of the key top is pressed by a printing type portion so that said top portion is indented as shown in FIG. 4A and the colored layer is transferred to this indented portion. In this case a protective layer is not formed because the stamping sheet does not have a protective layer. Therefore, a protective layer 37 is applied to the key top after stamping.

Figure 4C:
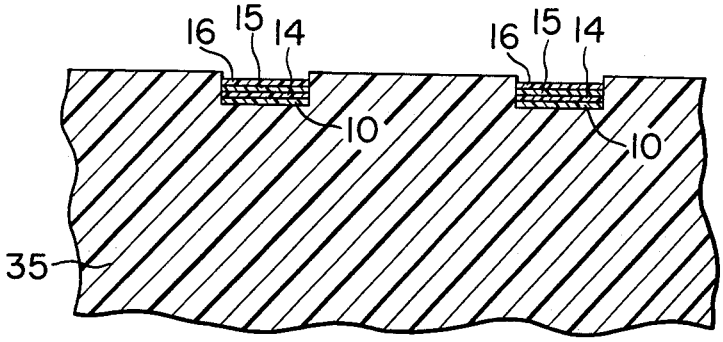
FIG. 4C is an enlarged cross sectional view of a key top of an embodiment of the present invention.

A stamping sheet used in the stamping method is not limited to that as illustrated in FIG. 4B, but the transferring sheet as described previously may be used (each layer on a printing base is uniformly formed on the whole area of the printing base). When such transferring sheet is used as a stamping sheet, an adhesion layer 10, a colored portion 14, a protective layer 15 and a peeling layer 16 are formed in indented portions of a key top as illustrated in FIG. 4C. In this case, any further protective layer is not necessary. However, if a stronger protection is desired, a further protective layer may be applied. The indented portions in FIG. 4C are deeper than those in FIG. 4A because the force pressing the printing type to the key top in FIG. 4C is stronger than that in FIG. 4A.

Figure 5:
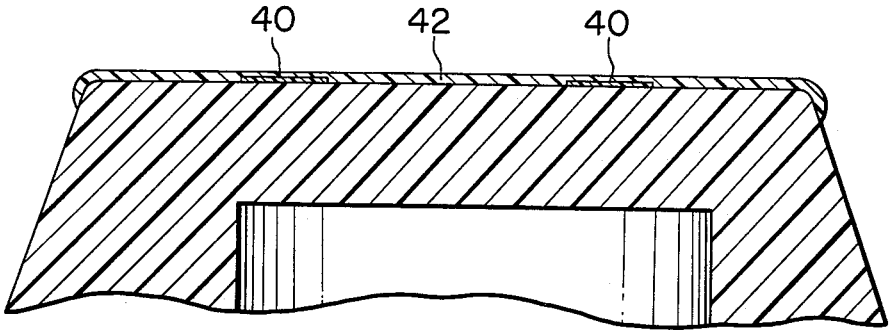
FIG. 5 is an enlarged cross sectional view of a key top of another embodiment of the present invention.

Referring to FIG. 5, colored portions 40 are fixed to the surface of top portion of a key top 41 and a protective layer is formed thereon.

The colored portion may be prepared, for example, by mixing a pigment with a composition of an adhesion layer is case of a transferring printing or mixing a composition of an adhesion layer with a colored portion in case of a transferring printing and adding a pigment thereto.

An example of formula for the colored portion is shown below.

| | |
|---|---|
| Synthetic resin | 7 parts |
| Polyvinyl chloride | 12 parts |
| Acrylic resin | 8 parts |
| Pigment | 12 parts |
| A mixture of xylene, methyl isobutyl ketone and butyl acetate | 51 parts |

An example of formula for a protective layer suitable for the above mentioned colored portion is shown below.

| | |
|---|---|
| Polyol | 25 parts |
| Isocyanate | 10 parts |
| A mixture of methyl isobutyl ketone, ethyl acetate, and toluene | 65 parts |

Such key top may be produced by directly printing the top portion of the key top according to a conventional printing method to form a colored portion and then applying a protective layer.

As is clear from the above description, the key top produced by the present invention has a colored portion on the top portion of a key top base previously manufacture by using a mold and thereby a complicated sign on a key top or a key top in a small production can be obtained easily at a low cost. At the top of the key top according to the present invention, there is provided a transparent protective layer of high abrasion resistance so that the colored portion is not damaged after long use.

We claim:

1. A key top which comprises:

i. a key top base composed of an integrally formed ABS resin having a side portion and a top portion, ii. a colored portion in the form of a sign provided on the top portion of the key top base, the colored portion consisting essentially of a mixture of polyvinyl chloride, polymethyl methacrylate and a colorant, iii. an adhering layer provided between the top portion of the key top base and the colored portion, the adhering layer consisting essentially of a mixture of styreen resin and synthetic rubber, iv. a protecting layer covering at least the colored portion, the protecting layer consisting essentially of a thermoplastic material of a mixture of polyvinyl chloride and nitrocellulose, and v. a second protecting layer covering the above mentioned protecting layer, the second protecting layer consisting essentially of a mixture of polyvinyl chloride, synthetic rubber, and silicon.

* * * * *

UNITED STATES PATENT AND TRADEMARK OFFICE

CERTIFICATE OF CORRECTION

PATENT NO. : 4,042,090

DATED : August 16, 1977

INVENTOR(S) : SADAO HASEBE, et al.

It is certified that error appears in the above-identified patent and that said Letters Patent are hereby corrected as shown below:

Column 2, line 52, change "12 on the top portion 13" to -- 13 on the top portion 12 --.
Column 4, line 59, change "base" to -- sheet --.
Column 5, line 16, change "on is" to -- one is --.
Column 8, line 2, change "styreen" to -- styrene --.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*